US009055794B1

(12) United States Patent
Gorouvein et al.

(10) Patent No.: US 9,055,794 B1
(45) Date of Patent: Jun. 16, 2015

(54) UMBRELLA CASE AND METHOD OF CONNECTING UMBRELLA TO A HANDLE

(71) Applicants: Edouard Gorouvein, Thornhill (CA); Maksim Gorouvein, Thornhill (CA)

(72) Inventors: Edouard Gorouvein, Thornhill (CA); Maksim Gorouvein, Thornhill (CA)

( * ) Notice: Subject to any disclaimer, the term of this patent is extended or adjusted under 35 U.S.C. 154(b) by 0 days.

(21) Appl. No.: 14/476,000

(22) Filed: Sep. 3, 2014

(51) Int. Cl.
*A45B 25/24* (2006.01)
*A45B 25/00* (2006.01)

(52) U.S. Cl.
CPC ..... *A45B 25/24* (2013.01); *A45B 25/00* (2013.01)

(58) Field of Classification Search
CPC ..... A45B 25/24
USPC ..... 135/15.1, 17, 34.2; 220/756; 7/167, 168
See application file for complete search history.

(56) References Cited

U.S. PATENT DOCUMENTS 1,031,361 A * 7/1912 Mitchell ..... 135/34.2
1,937,363 A * 11/1933 Seraphim ..... 135/25.41
D227,817 S * 7/1973 Kortenbach ..... D3/11
3,896,866 A * 7/1975 Hoffmann ..... 135/34.2
3,935,874 A * 2/1976 Cohen ..... 135/16
4,350,175 A * 9/1982 DeMarco ..... 135/34.2
5,261,560 A * 11/1993 Wang ..... 220/735
5,878,761 A * 3/1999 Vadher ..... 135/16
2009/0205693 A1 * 8/2009 Huang ..... 135/28

FOREIGN PATENT DOCUMENTS

WO WO 9636251 A1 * 11/1996
WO WO 9748303 A1 * 12/1997

* cited by examiner

*Primary Examiner* — David R Dunn
*Assistant Examiner* — Danielle Jakson
(74) *Attorney, Agent, or Firm* — Nadya Reingand; Yan Hankin

(57) ABSTRACT

An umbrella apparatus with a self-storing ability is disclosed. The apparatus comprises a handle portion which opens to reveal a folded umbrella rod, cupola, and ribs. The umbrella portion rotates to an open position and the handle is closed once again. The apparatus thus functions as an umbrella when needed, and as a case for holding the umbrella when the umbrella is not needed. The handle is capable of enclosing the entire umbrella in a folded form for easy portability. A method for connecting an umbrella to a multi-functional handle is also disclosed.

20 Claims, 8 Drawing Sheets

UMBRELLA CASE AND METHOD OF CONNECTING UMBRELLA TO A HANDLE

CROSS-REFERENCE TO RELATED APPLICATIONS

This patent application claims priority to, and incorporates fully by reference, U.S. Provisional Patent Application No. 61/890,200 filed on Oct. 12, 2013.

FIELD OF THE INVENTION

This invention relates generally to road, or portable, accessories, and in particular, to foldable and collapsible umbrellas.

BACKGROUND OF THE INVENTION

Most collapsible umbrellas are usually provided with a central telescopic stick, a radiating folding frame or rib assembly partially slidable on the central stick, and a circular fabric canopy or top cover fastened to the radiating frame. The stick is retracted and extended telescopically, the frame is folded and unfolded together with the canopy, and the umbrella as a whole is stretched and collapsed in two or three stages, for example, as disclosed in U.S. Pat. Nos. 4,080,976 and 4,105,039. In a fully collapsed condition, the umbrellas are stored within a rigid tubular sheath member, the length of which is approximately equal to that of the fully collapsed umbrella, as disclosed, for example, in U.S. Pat. Nos. 3,730,199 and 3,744,502.

U.S. Pat. No. 4,456,023, discloses a collapsible umbrella with a rigid tubular sheathing handle being attached to a central telescopic stick in such a way that the umbrella, in a fully collapsed condition, may be withdrawn in the sheathing handle in a completely water-tight manner when a sliding member fixed to the lower end of the stick is at the bottom of the tubular sheathing handle. And in a fully collapsed condition, the umbrella may be taken out of the sheathing handle to be opened for use when the sliding member is retained near the top end of the sheathing handle, thereby rendering the sheathing handle serviceable dually as a storing sheath when the umbrella is not in use and as a handle when it is in use.

U.S. Pat. No. 6,334,454 discloses a collapsible umbrella shaft attached to a cap having two sets of threads formed thereon. The cap is attachable to a housing by the threads in two alternate orientations to close the interior of the housing. In one cap orientation, the folded umbrella is in the interior of the housing. In the other cap orientation, the umbrella is deployed externally of the housing.

Other multi-functioning handles with umbrellas have been disclosed in international patent publication numbers WO 1997/048303 A1, DE 10217280 A1, JPH0937825, JP 2003169707, and FR 2037678. Rather than requiring an additional and separate cover, the handles disclosed in these publications serve additionally as covers for the umbrellas when the umbrellas are not in use.

SUMMARY OF THE INVENTION

The present invention is an umbrella apparatus, comprising a rod, a cupola, and ribs, together forming an umbrella portion, where the umbrella portion is connected to a second portion serving as both a handle and a carrying case. The umbrella portion and second portion are connected via a rotating joint between the rod and the handle, wherein the handle comprises two rotating halves connected via a hinge, where the halves form a case which opens and closes, as well as a cover connected to an external side of said case. The second portion is used both to hold an open umbrella portion (as a handle) and to store a folded umbrella portion (as a case).

In some aspects, the umbrella apparatus further comprises a fixing member for locking the rod in an open position and/or another fixing member for locking the rod in a folded position. In some aspects, this fixing member is the same member.

In some aspects, the rod is a telescopic rod.

In some aspects, the case is box-shaped. In other aspects, the case is elliptical in shape.

In some aspects, the rotating joint and the hinge are located on opposite ends of the case. In other aspects, the rotating joint and the hinge are located on the same end of the case.

In some aspects, the rod, connected via the rotating joint, and the two rotating halves, connected via the hinge, rotate about individual axes which are parallel to each other. In other aspects, the rod, connected via the rotating joint, and the two rotating halves, connected via the hinge, rotate about individual axes which are not parallel to each other.

In some aspects, the rod opens to and is fixed at a non-linear angle relative to the handle. In other aspects, the rod opens, rotating a full 180 degrees, and is fixed linearly with the handle.

In some aspects, the hinge is located along a length of said case and said rotating joint is located on an edge of said case which is adjacent to said length of the case.

In another embodiment of the present invention, an umbrella apparatus comprises a rod, a cupola, and ribs, together forming an umbrella portion, where the umbrella portion is connected to a handle via a stabilized joint between the rod and the handle, wherein the handle comprises two rotating halves connected via a hinge located at the same end of the handle as the stabilized joint. The halves form a case for opening and closing and storing the umbrella when folded, and a cover is also connected to an external side of the case. Then, the handle can be used both to hold an open umbrella portion and to store a folded umbrella portion. The rod additionally extends telescopically in order to open the umbrella portion.

Also disclosed herein is a method for connecting a special handle with a standard umbrella portion, thus forming the apparatus described herein. The method comprises coupling a rod of the umbrella via a joint with an inner portion of a box-shaped case, the case comprising two parts forming a shell, where the parts are connected via a hinge and rotate about the hinge for opening and closing of the case. The joint comprises a ball joint for opening and closing the umbrella by rotating the rod between an external position relative to the case and an internal position for storage, and the case serves both as a storage means when the umbrella is carried in a closed position as well as a special handle when the umbrella is carried in an open position. Similar additional aspects may be included in the method, as described with regard to the apparatus above.

BRIEF DESCRIPTION OF THE DRAWINGS

FIGS. 3 through 5 show example schematics of the successive opening of one embodiment of an umbrella according to the present invention.

FIG. 3 specifically shows an umbrella when it is fully closed and located within a case/cover yet to be closed.

FIG. 5 specifically shows an example of the umbrella cupola in an extended or open position, rotated 180 degrees from its closed position, and fixed in such open position just before the case is closed to serve as a handle.

FIG. 7 specifically shows a fully closed umbrella.

FIG. 8 specifically shows a first step of opening a closed umbrella.

FIG. 9 specifically shows a second step of opening a closed umbrella.

FIG. 10 specifically shows an umbrella outside of a closed case.

FIG. 11 specifically shows a fully open umbrella.

FIG. 12 specifically shows a fully closed umbrella.

FIG. 13 specifically shows a first step of opening this particular embodiment of an umbrella.

FIG. 14 specifically shows a second step of opening this particular embodiment of an umbrella.

FIG. 15 specifically shows an umbrella outside of a closed case.

FIG. 16 specifically shows a fully open umbrella.

Detailed Description of the Preferred Embodiment

Figure 1:
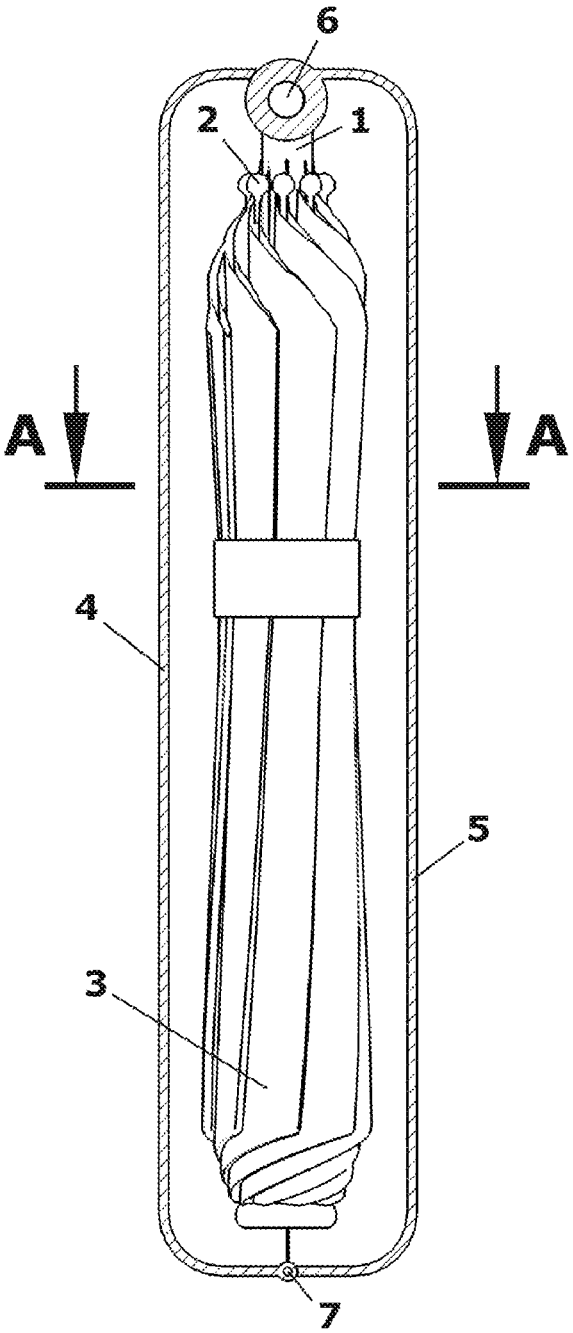
FIG. 1 shows a sectional side view of an umbrella according to the present invention in a folded or closed form.
Figure 2:
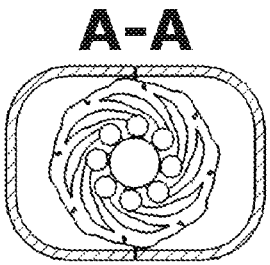
FIG. 2 shows a sectional top view (A-A) of the same umbrella as that in FIG. 1.
Figure 3:
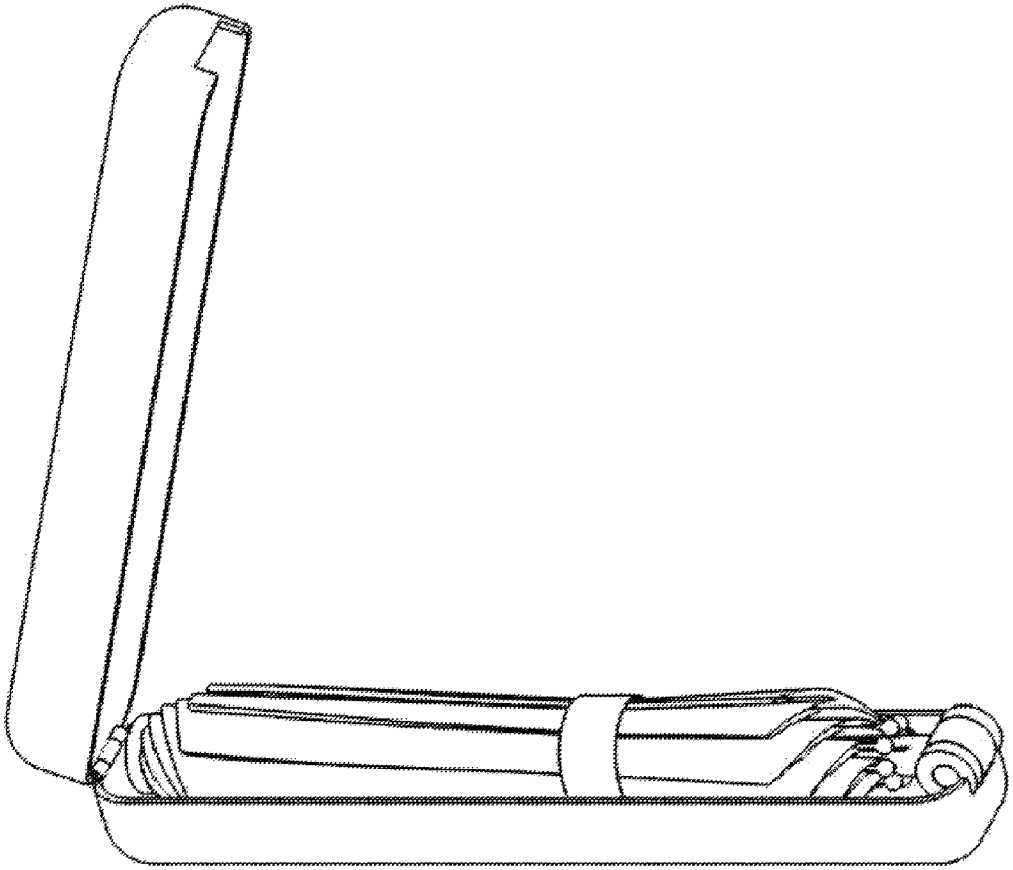

An apparatus according to the present invention comprises a rod 1, where one end of the rod is connected with a system of ribs 2 holding a cupola 3 (in combination, the rod, ribs, and cupola comprise the "umbrella") and a handle 5 in the form of a box-shaped case, which also acts as a cover, or case, for the umbrella when it is in a folded, or closed, position. One side (or end) of the handle 5 is connected to one end of the rod 1 via a first joint 6. A cover 4 is connected to the external side of the handle, which opens and closes via a second joint 7 located on the opposite end of the first joint 6 (it should be noted that in other embodiments of the present invention, it is possible for the first and second joints to be locate at the same end of the handle). The handle 5 has a rectangular, oval, or similar shaped cross-section, being convenient both to hold a stored umbrella and to be carried in a user's hand (when the umbrella is either open or being stored). The first joint 6 further comprises a fixing member to lock (or fix) the rod 1 in an "Open" and "Closed" (or stored) umbrella position. The cover 4 may also further comprise a latch to fix it in the "closed" position when the handle is closed.

Figure 4A:
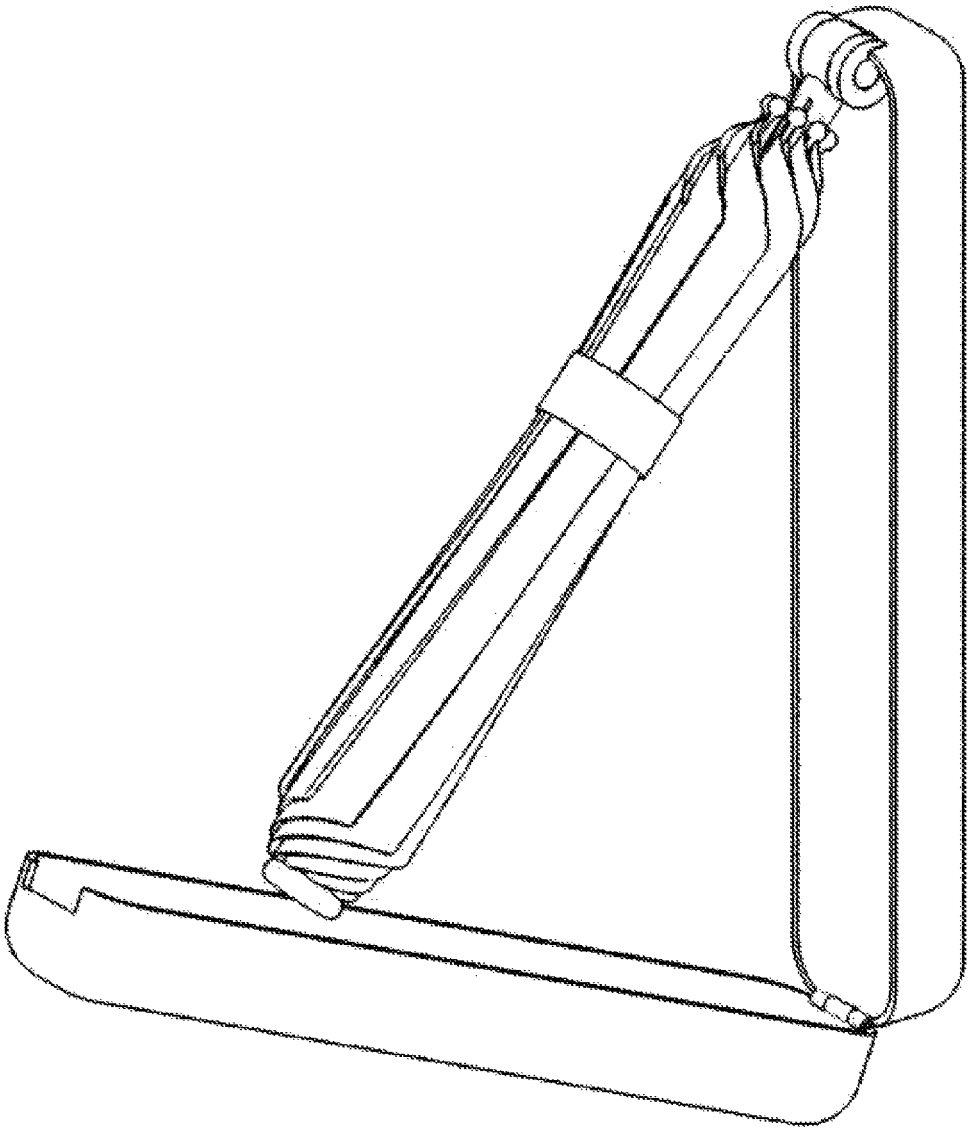
FIGS. 4*a* and 4*b* show an example of how the umbrella cupola may be sequentially rotated out of the cover/case towards an open position.
Figure 4B:
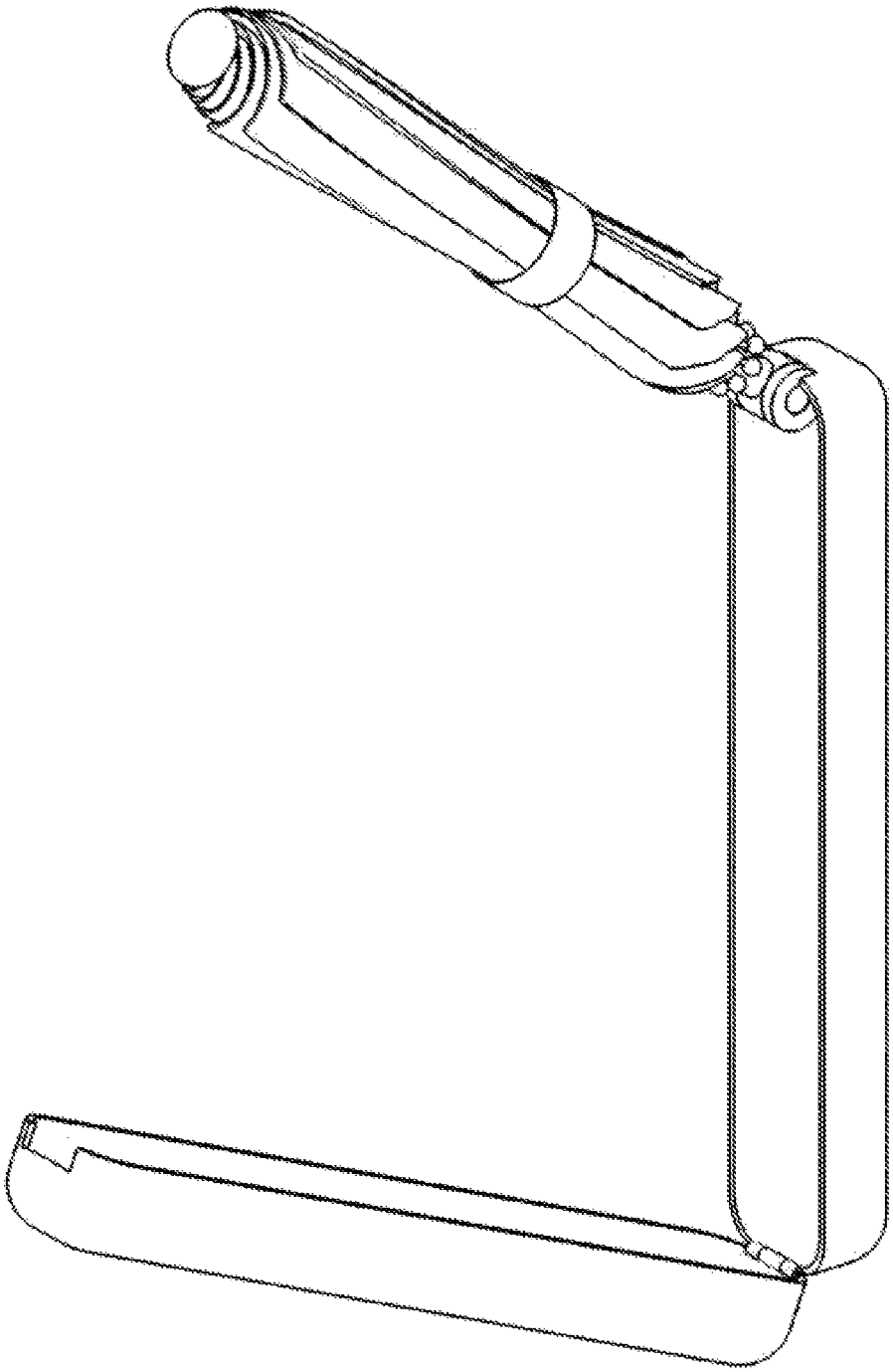
Figure 5:
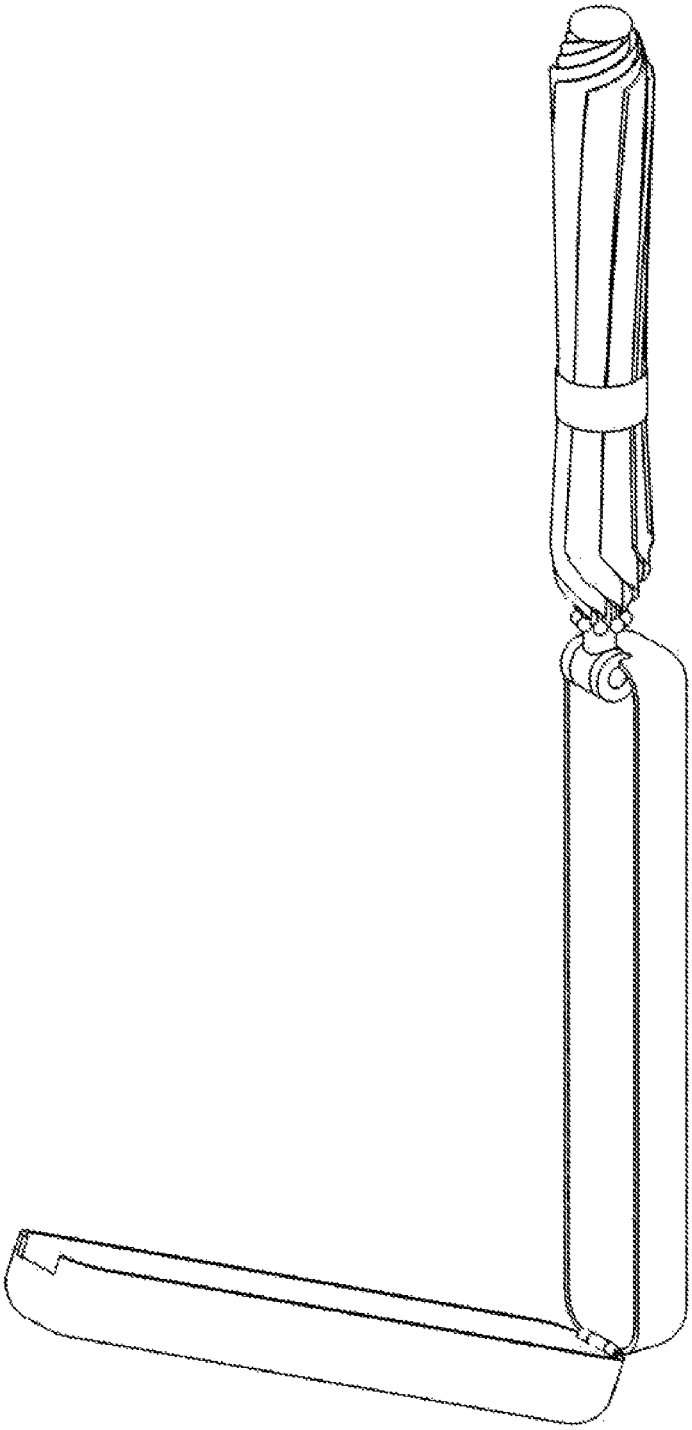
Figure 10:
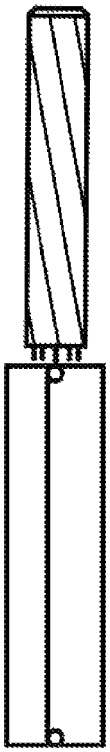
Figure 11:
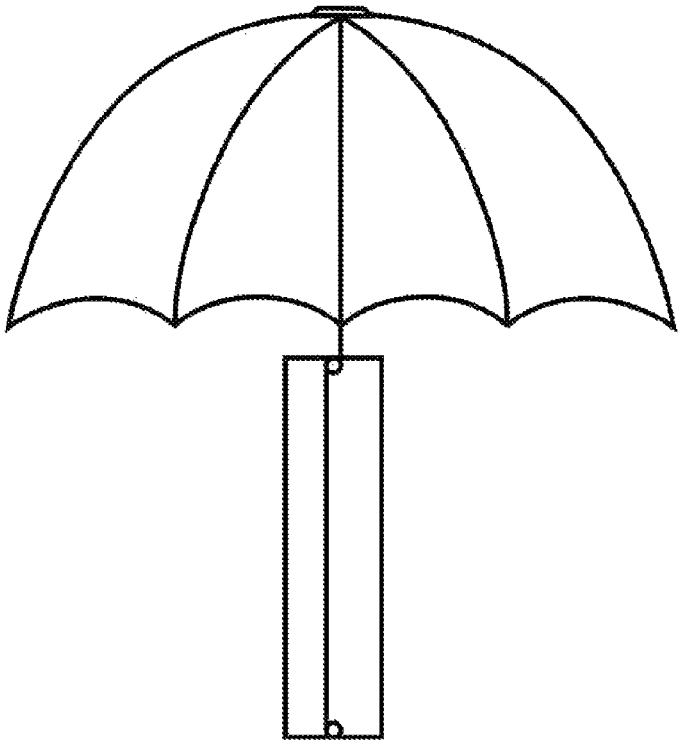
Figure 12:
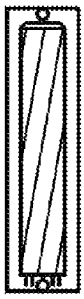
FIGS. 12 through 16 show example schematics of the successive opening of an umbrella according to the present invention, wherein the umbrella rod extends and does not rotate, and wherein the joint rotation axis of the cover, comprising a box-shaped case, is located on the lower end of the case.
Figure 13:
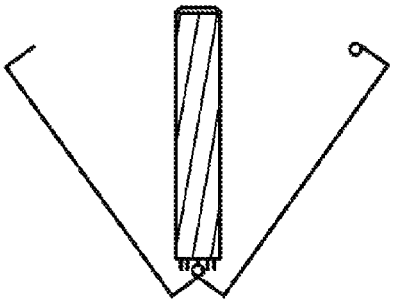
Figure 14:
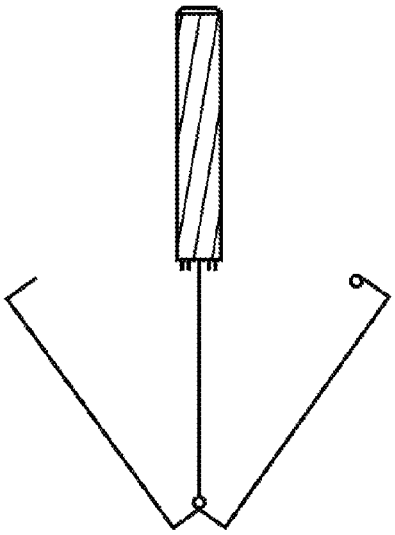
Figure 15:
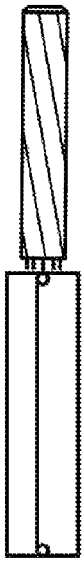
Figure 16:
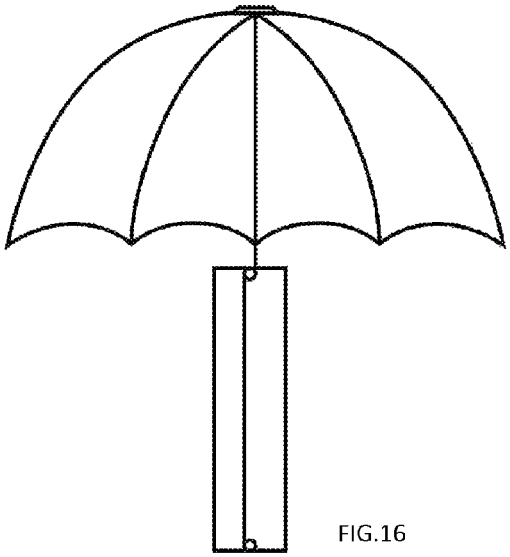

The apparatus may be opened in the following exemplary manner:

The handle 5 may be opened by turning a first half of the handle around the axis of the second joint 7 in a counterclockwise direction (FIGS. 4*a* and 4*b*). Once the handle is in an open position, the closed umbrella is released from the fixing member in the "stored" position and turned around the axis of the first joint 6 in a clockwise direction a total of 180 degrees to align the rod with the longitudinal axis (i.e. length) of the handle 5. The apparatus is then fixed in the "Open" position (FIG. 5) by the fixing member. The handle 5 is closed by recombining the halves of the handle into a closed position (now empty inside because the umbrella portion has been rotated out to an external position), thus forming a handle for the umbrella (such as shown in FIG. 10). Finally, the cupola 3 is opened (using any known methods) and the apparatus may be used as an umbrella, wherein the case now serves as a handle.

The apparatus may be closed in the following exemplary manner:

The cupola 3 of the umbrella is folded to form a closed umbrella, and the handle 5 is opened in a manner similar to that discussed above. The closed umbrella is released from the fixing member for locking in the "open" position, rotated around the axis of the first joint 6 in a counterclockwise direction a total of 180 degrees, thus being placed back inside the handle 5, and fixed in a "Closed" position by the fixing member for locking in the closed position. The handle 5 is closed in a similar manner as above, and the handle is locked via a fixing member of the handle and/or a fixing member (e.g., latch) of the cover 4. The shape of the case enables reduction of the force required to hold an umbrella in a user's hand, while simultaneously improving transportability of the umbrella.

Figure 6:
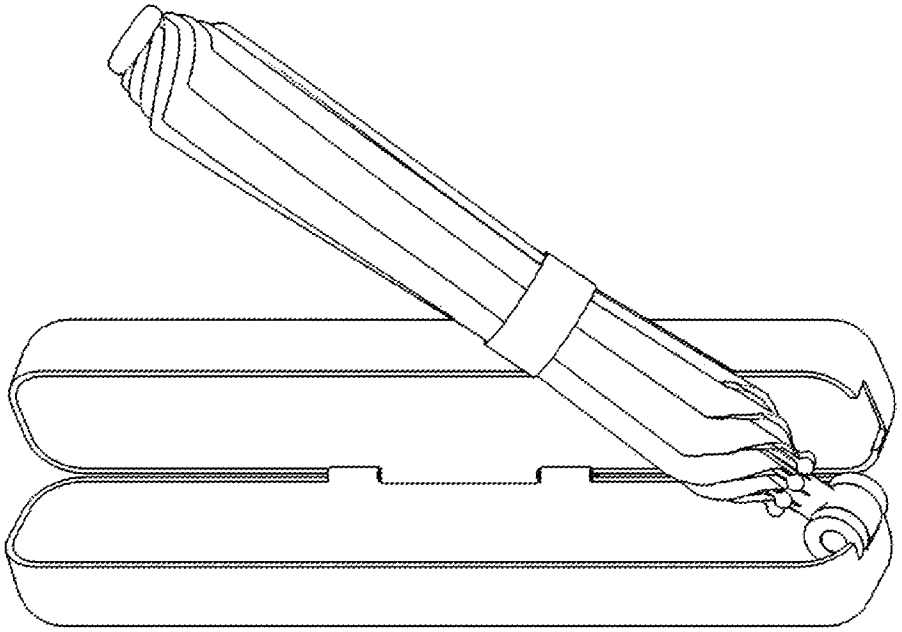
FIG. 6 shows yet another example embodiment of the present invention, wherein the joint rotation axis of the umbrella rod is located on either end of the case, while the joint rotation axis or axes of the cover are located along the length of the cover, rather than either end.
Figure 7:
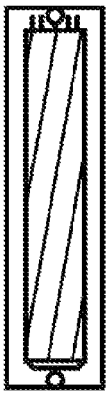
FIGS. 7 through 11 show example schematics of the successive opening of one embodiment of an umbrella according to the present invention, wherein the joint rotation axis of the umbrella rod and the joint rotation axis of the cover, comprising a box-shaped case, are located on opposite ends of the case.
Figure 8:
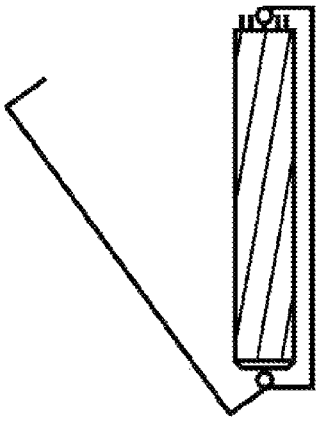
Figure 9:
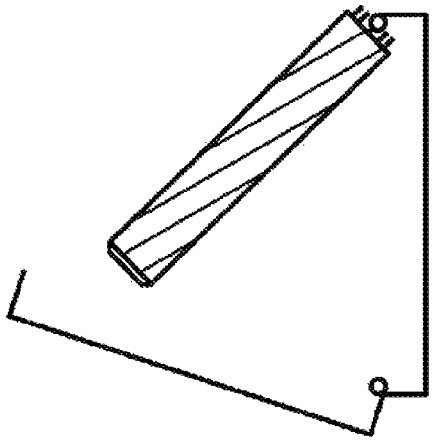

Another embodiment of the present invention is shown in FIG. 6. The second joint (i.e., the hinge for opening the handle) is located along the length of the case, similar to that of a case for eyeglasses. The umbrella similarly rotates about an axis of a joint in order to open and close as described above (in this type of embodiment, the joint and hinge(s) will be located on adjacent edges of the case, rather than opposite ends). The fixing member for keeping the handle in a closed position may then be located on any edge of the handle other than the edge which contains the hinge for opening the handle.

The present invention also comprises a method for making an apparatus which connects a special handle with a standard umbrella portion (i.e., the rod, ribs, and cupola). The method for making the apparatus comprises connecting the rod of an umbrella to a special handle which opens and closes via one or more hinges (or joints) connecting two portions of the handle (forming a shell which can hold the umbrella) and a locking mechanism located on the opposite edge of the handle. The handle doubles as a case for storing the umbrella when it is not being used. Furthermore, the handle may comprise a first half (or part) and a second half, wherein the hinge connects the halves to each other, and wherein the locking mechanism keeps the halves together to form a closed handle. The halves, or parts, comprising the handle need not be of equal size. The rod of the umbrella is connected to the handle via a second hinge (or ball joint), which allows the umbrella rod to rotate about an axis (switching between open (i.e. external) and closed (i.e. internal) positions). Alternatively, the rod of the umbrella may be connected to the handle at the same end as the hinge connecting the halves of the handle, in which case the umbrella would extend in a telescopic manner, rather than rotating about an axis. In this case, the halves of the handle are closed around the extended telescopic rod of the umbrella (rather than a completely empty case). A preferred handle comprises a box-shaped case to accommodate a telescopic rod, a cupola, and ribs of a folded umbrella. The rod of the umbrella in an open position may be further rigidly fixed to the handle via a fixing member located on the second hinge (or ball joint). It should be noted that the angle at which the rod of an umbrella is rigidly fixed may be an angle other than 180 degrees to the longitudinal direction of a closed handle. Various embodiments comprise various angles (e.g., 90, 100, 110, 120, 130, 140 degrees, etc.) between a fixed umbrella rod and the handle.

Various embodiments of the present invention employ hinges and joints in various combinations of locations. In one embodiment, a first joint is located on one end of the handle, while a second joint is located on the opposite end of the handle. Thus, the halves of the handle are permanently connected on one end of the handle, while the umbrella is attached to the opposite end of the handle (See FIG. 7-11). Accordingly, the halves of the handle rotate along a parallel axis, and the umbrella rod rotates on an axis depending on the type of joint employed (e.g., parallel, ball, etc.). These two axes may or may not be parallel to one another (i.e., the processes occurring at each axis may at an angle to one another, e.g., 90 degrees). Furthermore, when the apparatus is opened for use (or closed for storage), the processes occurring at each axis may or may not coincide (i.e. occur simultaneously). In another embodiment, there is only one joint connecting halves of the handle. The halves open in a similar manner, but instead of rotating the umbrella rod around an axis on the opposite end of the handle, the rod is coupled to the same end of the handle as the joint connecting halves of the handle. The rod then simply extends and retracts (using any known methods), instead of rotating, to form an open umbrella rod. The handle is then closed and the cupola may be opened (See FIGS. 12-16). Fixing members may or may not be used to keep the umbrella in a desired position.

In yet further embodiments, the handle comprises, on the outside and/or the inside surface of the handle, a soft and moldable material (e.g. memory foam, absorbent element), capable of changing shape in order to fit a particular user's hand and/or a stored umbrella inside the handle acting as a case. When the moldable material is on the inside surface of the handle, the inner volume is increased by molding to the shape of the closed umbrella. When the moldable material is on the outside surface of the handle, it adjusts to the particular hand of a user, making it more convenient for an individual's unique hand (including both larger and smaller hands). The moldable material on the outside surface of the handle may be located along the entire outside surface or, alternatively, only where a user's hand is meant to grip the handle (e.g., bottom/lower portion). The moldable material may further comprise a disposable and replaceable material, for easy substitution and maintenance.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. An apparatus, comprising: a rod, a cupola, and ribs, forming an umbrella portion, said umbrella portion being connected to a handle via a rotating joint between said rod and said handle, wherein said handle comprises two rotating halves connected via a hinge, forming a case for opening and closing, the case comprising two longitudinal sides, an upper end and a lower end, wherein the joint is positioned between a lower end of the rod and on an edge of either the upper end or the lower end of the case so that the joint extends partially outside of the handle, wherein the handle is used to hold an open umbrella portion and to store a folded umbrella portion.

2. The apparatus of claim 1, wherein said case serves as a fixing member for locking the rod in an open position.

3. The apparatus of claim 1, wherein said case serves as a fixing member for locking the rod in a folded position.

4. The apparatus of claim 1, wherein the rod is a telescopic rod.

5. The apparatus of claim 1, wherein the case is box-shaped.

6. The apparatus of claim 1, wherein the case is elliptical in shape.

7. The apparatus of claim 1, wherein the rotating joint and the hinge are located on opposite ends of the case.

8. The apparatus of claim wherein the rotating joint and the hinge are located on the same end of the case.

9. The apparatus of claim 1, wherein the rod, connected via, the rotating joint, and the two rotating halves, connected via the hinge, rotate about individual axes winch are parallel to each other.

10. The apparatus of claim 1, wherein the rod, connected via the rotating joint, and the two rotating halves, connected via the hinge, rotate about individual axes which are not parallel to each other.

11. The apparatus of claim 1, wherein the rod rotates less than 180 degrees and is fixed at a non-linear angle relative to the handle.

12. The apparatus of claim 1, wherein the rod rotates a full 180 degrees and is fixed linearly with the handle.

13. The apparatus of claim 1, wherein said hinge is located along length of said case and said rotating joint is located on an edge of said case which is adjacent to said length of the case.

14. An umbrella apparatus, comprising a rod, a cupola, and ribs, together forming an umbrella portion, said umbrella portion being connected to a handle via a stabilized non-rotating joint between said rod and said handle, wherein said handle comprises two rotating halves connected via a hinge located at the same end of the handle as the stabilized joint, said halves forming a case for opening and closing, the case having an upper end and a lower end, and the joint positioned on the lower end of the case, wherein said joint couples the rod to the case so that the rod extends out of the case, wherein the handle is used both to hold an open umbrella portion and to store a folded umbrella portion, and wherein the rod extends telescopically to open said umbrella portion.

15. A method for connecting a special handle with a standard umbrella portion, comprising:

connecting a rod of an umbrella via a joint with an inner portion of a box-shaped case, said case comprising two parts forming a shell, said parts being connected via a hinge, wherein said parts rotate about said hinge for opening and closing of the case, the case comprising two longitudinal sides, an upper end and a lower end, and positioning the joint between a lower end of the rod and on an edge of either the upper end or the lower end of the case, wherein said joint either comprises a ball joint for opening and closing, the umbrella by rotating the rod between an external position relative to the case and an internal portion for storage, wherein the ball joint extends partially outside of the handle, or a non-rotating joint which couples the rod to the case, so that the rod extends out of the case, and wherein said case serves both as a storage means when the umbrella is carried in a closed position and as the special handle when the umbrella is carried iii an open position.

16. The method of claim 15, wherein said joint is a ball joint, and said joint and said hinge are located on opposite ends of the case.

17. The method of claim 15, wherein said joint and said hinge are located on adjacent edges of said case.

18. The method of claim 15, wherein said joint is a non-rotating joint, and said joint and said hinge are located on the same end of the case.

19. The method of claim 15, further comprising locking said rod in any external position via a fixing member wherein the case serves as the fixing member.

20. The method of claim 15, further comprising extending and retracting said rod telescopically.

* * * * *